US010907628B2

(12) United States Patent
Sakai

(10) Patent No.: US 10,907,628 B2
(45) Date of Patent: Feb. 2, 2021

(54) ELECTRIC COMPRESSOR

(71) Applicant: DENSO CORPORATION, Kariya (JP)

(72) Inventor: Koji Sakai, Kariya (JP)

(73) Assignee: DENSO CORPORATION, Kariya (JP)

( * ) Notice: Subject to any disclaimer, the term of this patent is extended or adjusted under 35 U.S.C. 154(b) by 344 days.

(21) Appl. No.: 15/774,333

(22) PCT Filed: Oct. 25, 2016

(86) PCT No.: PCT/JP2016/081606
§ 371 (c)(1),
(2) Date: May 8, 2018

(87) PCT Pub. No.: WO2017/082045
PCT Pub. Date: May 18, 2017

(65) Prior Publication Data

US 2020/0248681 A1 Aug. 6, 2020

(30) Foreign Application Priority Data

Nov. 12, 2015 (JP) ..... 2015-221763

(51) Int. Cl.
*F04B 49/06* (2006.01)
*F04B 35/04* (2006.01)
*F04B 49/10* (2006.01)

(52) U.S. Cl.
CPC ..... *F04B 49/06* (2013.01); *F04B 35/04* (2013.01); *F04B 49/10* (2013.01); *F04B 2203/0201* (2013.01); *F04C 2240/808* (2013.01); *F25B 2600/021* (2013.01)

(58) Field of Classification Search
CPC ..... F04B 35/06; F04B 49/06; F04B 49/10; F04B 2303/0201; F04C 2240/808; F25B 2600/021
See application file for complete search history.

(56) References Cited

U.S. PATENT DOCUMENTS

2003/0143090 A1 7/2003 Iritani et al.
2009/0324426 A1* 12/2009 Moody ..... F04B 39/0207 417/13
2015/0176583 A1 6/2015 Murase et al.
2015/0295532 A1 10/2015 Sakai
2017/0037844 A1* 2/2017 Takeuchi ..... F04B 49/02

FOREIGN PATENT DOCUMENTS

JP H08048140 A 2/1996
JP 2003222078 A 8/2003
JP 2006029342 A 2/2006
JP 2012-82763 A 4/2012
JP 2012249355 A 12/2012
JP 2014005795 A 1/2014
JP 2014020266 A 2/2014

* cited by examiner

*Primary Examiner* — Marc E Norman
(74) *Attorney, Agent, or Firm* — Harness, Dickey & Pierce, P.L.C.

(57) ABSTRACT

An inverter is disposed at a position on the upstream side relative to a compression mechanism along the flow of a refrigerant and the position cooled by the refrigerant. A motor is disposed at a position heated by the refrigerant compressed by the compression mechanism. A control device changes an upper limit value of a driving current supplied to the motor on the basis of at least one of first information relating to the temperature of the motor or second information relating to the temperature of the inverter.

6 Claims, 14 Drawing Sheets

ELECTRIC COMPRESSOR

CROSS REFERENCE TO RELATED APPLICATIONS

This application is a U.S. National Phase Application under 35 U.S.C. 371 of International Application No. PCT/JP2016/081606 filed on Oct. 25, 2016 and published in Japanese as WO 2017/082045 A1 on May 18, 2017. This application is based on and claims the benefits of priority from Japanese Patent Application No. 2015-221763 filed on Nov. 12, 2015. The entire disclosures of all of the above applications are incorporated herein by reference.

TECHNICAL FIELD

The present disclosure relates to an electric compressor that compresses and feeds out a refrigerant supplied to the electric compressor.

BACKGROUND ART

An electric compressor operates a compression mechanism by a driving force of a motor to compress a supplied refrigerant and feed the compressed refrigerant to the outside. The electric compressor having such a configuration is used as an apparatus for circulating a refrigerant in a refrigeration cycle.

An electric compressor described in Patent Literature 1 has a configuration in which a motor, an inverter for supplying a driving current to the motor, and a compression mechanism which compresses a refrigerant are stored inside a casing. The compression mechanism is disposed at a position on the most downstream side along the flow of the refrigerant. The motor and the inverter are disposed at positions on the upstream side relative to the compression mechanism along the flow of the refrigerant. In this manner, the motor and the compression mechanism are disposed side by side in the flow direction of the refrigerant. Thus, the entire size of the electric compressor is relatively large.

In an electric compressor described in Patent Literature 2, substantially the whole of a compression mechanism is disposed inside a motor, specifically, at a position inside a stator and a rotor of the motor. That is, the compression mechanism and the motor are disposed at substantially the same position. Thus, the electric compressor of Patent Literature 2 is compact as compared to the electric compressor described in Patent Literature 1.

PRIOR ART LITERATURES

Patent Literatures

Patent Literature 1: JP-2003-222078-A
Patent Literature 2: JP-2014-5795-A

SUMMARY OF INVENTION

In a refrigeration cycle, a low-temperature and low-pressure refrigerant that has evaporated by an evaporator is supplied to an electric compressor. The refrigerant is compressed by a compression mechanism inside the electric compressor to high temperature and high pressure.

Thus, when the compression mechanism is disposed near the motor like the electric compressor described in Patent Literature 2, the motor is heated by a high-temperature refrigerant, and the temperature of the motor rises. As a result, the magnetic flux density of the motor decreases, and the motor may become unable to output a torque required for operating the compression mechanism.

In particular, a torque required for the compression mechanism is high during a startup of the electric compressor. Thus, when the electric compressor is restarted within a relatively short time after a stop of the electric compressor, a required torque may not be output due to a high temperature of the motor, and the electric compressor may fail to restart.

The present disclosure has been made in view of the above matter, and an object thereof is to provide an electric compressor capable of preventing a decrease in torque even when a motor is heated by a compressed high-temperature refrigerant and the temperature of the motor rises.

To address the above matter, an electric compressor according to the present disclosure is an electric compressor (10) that compresses and feeds out a refrigerant supplied to the electric compressor, including a motor (140), a compression mechanism (150) that is driven by the motor to compress the refrigerant, an inverter (130) that supplies a driving current to the motor, and a control device (180) that controls an operation of the inverter. The inverter is disposed at a position which is upstream of the compression mechanism along a flow of the refrigerant and which is cooled by the refrigerant. The motor is disposed at a position heated by the refrigerant compressed by the compression mechanism. The control device changes an upper limit value of the driving current supplied to the motor based on at least one of a first information relating to a temperature of the motor or a second information relating to a temperature of the inverter.

In the electric compressor having such a configuration, the upper limit value of the driving current is changed based on at least one of the first information or the second information. For example, when the temperature of the motor is high, a torque required for operating the compression mechanism can be secured by changing the upper limit value to a value higher than a value under normal conditions.

When the upper limit value of the driving current is changed to a value higher than the normal value, heat generation of the inverter increases. Thus, it is considered that the temperature of the inverter increases, which may make the operation unstable. However, in the electric compressor having the above configuration, the inverter is disposed at the position on the upstream side relative to the compression mechanism and the position cooled by the refrigerant. Thus, even when the heat generation amount of the inverter increases due to the change in the upper limit value, an excessive temperature rise in the inverter is prevented.

The present disclosure provides an electric compressor capable of preventing a decrease in torque even when a motor is heated by a compressed high-temperature refrigerant and the temperature of the motor rises.

EMBODIMENTS FOR CARRYING OUT INVENTION

Hereinbelow, embodiments will be described with reference to the accompanying drawings. Identical elements will be designated by the same reference sign throughout the drawings as far as possible to facilitate understanding of description, and redundant description will be omitted.

The configuration of an electric compressor 10 according to a first embodiment will be described with reference to FIG. 1. The electric compressor 10 is configured as an apparatus for circulating a refrigerant in a refrigeration cycle (not illustrated). The electric compressor 10 compresses, inside thereof, a low-temperature and low-pressure refrigerant supplied from an evaporator which is disposed on the upstream side to bring the refrigerant into a high-temperature and high-temperature state, and feeds the compressed refrigerant to a condenser which is disposed on the downstream side.

Figure 1:
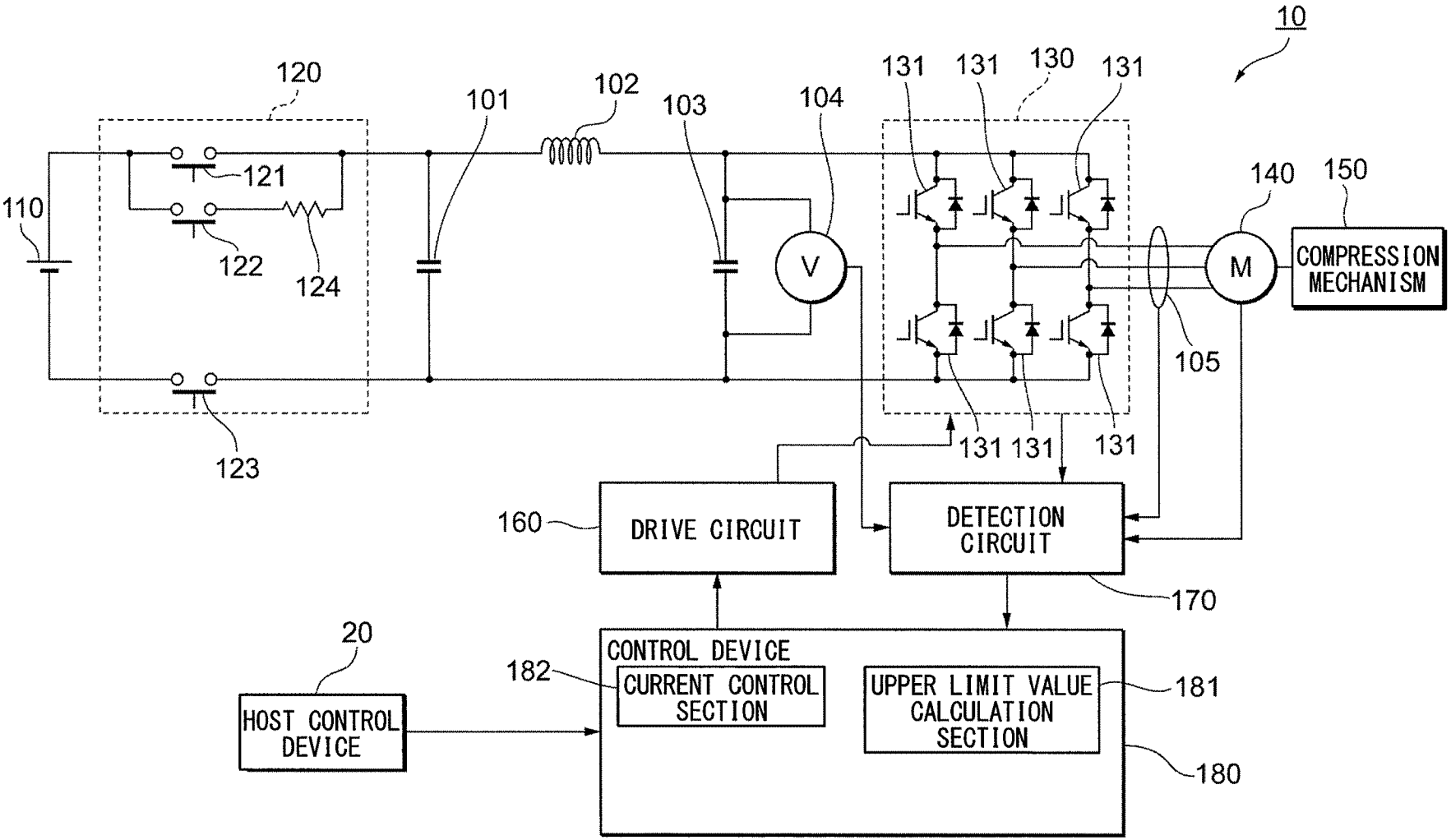
FIG. 1 is a diagram schematically illustrating the entire configuration of an electric compressor according to a first embodiment.

As schematically illustrated in FIG. 1, the electric compressor 10 includes a high-voltage battery 110, a relay system 120, an inverter 130, a motor 140, a compression mechanism 150, and a control device 180. A drive circuit 160 and a detection circuit 170 are disposed between the inverter 130 and the control device 180.

The high-voltage battery 110 is a power storage device that outputs a direct current. The direct current output from the high-voltage battery 110 is converted to an alternating current by the inverter 130 (described below) and supplied as a driving current to the motor 140. The high-voltage battery 110 may be provided as a dedicated power storage device for supplying current to the electric compressor 10 or may be provided as a power storage device that supplies a direct current not only to the electric compressor 10, but also to another power consuming device.

The relay system 120 is disposed at a position between the high-voltage battery 110 and the inverter 130. The relay system 120 includes three relays 121, 122, 123 and a protective resistor 124. The supply and interruption of current between the high-voltage battery 110 and the inverter 130 are switched by opening and closing operations of the relays 121, 122, 123.

When the supply of current from the high-voltage battery 110 is started, first, the relay 121 remains in an open state, and the relay 122 and the relay 123 are brought into a closed state. At this time, the current from the high-voltage battery 110 passes through the protective resistor 124. Thus, the occurrence of an excessive rush current with the application of high voltage is suppressed. Then, the relay 121 is brought into a closed state, and the relay 122 is brought into an open state. The opening and closing operations of the relays 121, 122, 123 are controlled by the control device 180. When any abnormality occurs in the electric compressor 10, the relays 121, 122, 123 are brought into an open state to interrupt the supply of current from the high-voltage battery 110.

The inverter 130 is a circuit for converting a direct current supplied from the high-voltage battery 110 to a three-phase alternating current and supplies the three-phase alternating current as a driving current to the motor 140. As illustrated in FIG. 1, the inverter 130 is configured as a three-phase full-bridge inverter circuit.

The inverter 130 includes six switching elements 131 each of which includes an IGBT and a freewheel diode. The six switching elements 131 constitute three upper arms and three lower arms. The magnitude of a driving current supplied to the motor 140 is regulated by the duty of switching operations performed by the switching elements 131.

A smoothing circuit which includes capacitors 101, 103 and a coil 102 is disposed between the relay system 120 and the inverter 130. The smoothing circuit smooths a direct current input to the inverter 130.

A voltmeter 104 is disposed near the capacitor 103. The voltmeter 104 is used for measuring a voltage applied between the opposite ends of the capacitor 103, that is, a voltage of a direct-current power input to the inverter 130. A voltage value measured by the voltmeter 104 is input to the detection circuit 170.

An ammeter 105 is disposed on an output part of the inverter 130, that is, between the inverter 130 and the motor 140. The ammeter 105 is used for measuring the magnitude of a driving current supplied from the inverter 130 to the motor 140. A current value measured by the ammeter 105 is input to the detection circuit 170.

The motor 140 is an electric rotating machine that is operated by receiving the supply of three-phase alternating current of U-phase, V-phase, and W-phase. When a driving current is supplied to the motor 140, a driving force of the motor 140 is transmitted to the compression mechanism 150, and the compression mechanism 150 compresses a refrigerant. Although FIG. 1 schematically illustrates the motor 140 and the compression mechanism 150 which are separated from each other, the motor 140 and the compression mechanism 150 are disposed at substantially the same position in practice. A specific arrangement of the motor 140 and the compression mechanism 150 will be described later with reference to FIG. 2.

The drive circuit 160 is a circuit for generating a driving signal for causing the inverter 130 to perform a switching operation and transmitting the driving signal to the inverter 130. The driving signal is generated on the basis of a modulation signal transmitted from the control device 180 to the drive circuit 160. That is, the control device 180 transmits the driving signal to the inverter 130 through the drive circuit 160 to control the switching operation of the inverter 130. The drive circuit 160 may be provided as a device separated from the control device 180 or may be disposed inside the control device 180.

The detection circuit 170 is a circuit for receiving signals from sensors disposed in respective parts of the electric compressor 10, and appropriately converting each of the signals and transmitting the converted signal to the control device 180. The control device 180 is capable of grasping a state amount detected by each of the sensors on the basis of the signal transmitted from the detection circuit 170. The detection circuit 170 may be provided as a device separated from the control device 180 or may be disposed inside the control device 180. In FIG. 1, among the sensors disposed in the respective parts of the electric compressor 10, only the voltmeter 104 and the ammeter 105 described above are illustrated.

The inverter 130 is provided with a temperature sensor (not illustrated) for measuring the temperature of the inverter 130. The temperature of the inverter 130 measured by the temperature sensor is transmitted to the control device 180 through the detection circuit 170. The "temperature of the inverter 130" indicates, for example, a temperature in a part near the switching elements 131 on a circuit board of the inverter 130.

The motor 140 is provided with a temperature sensor (not illustrated) for measuring the temperature of the motor 140. The temperature of the motor 140 measured by the temperature sensor is transmitted to the control device 180 through the detection circuit 170. The "temperature of the motor 140" indicates, for example, a temperature in a stator of the motor 140 or a part near the stator.

The control device 180 controls the entire operation of the electric compressor 10. The control device 180 is configured as a computer system that includes a CPU, a ROM, a RAM, and a communication interface. The control device 180 transmits a modulation signal to the drive circuit 160 to control the switching operation of the inverter 130 so that an appropriate driving current is supplied to the motor 140. The control device 180 controls an opening and closing operation of the relay system 120 to perform switching between the supply and interruption of current between the high-voltage battery 110 and the inverter 130.

The control device 180 includes an upper limit value calculation section 181 and a current control section 182 as functional control blocks. The upper limit value calculation section 181 is a part that calculates and sets an upper limit value of a driving current supplied from the inverter 130 to the motor 140. The current control section 182 is a part that transmits a modulation signal to the drive circuit 160 to control a driving current output from the inverter 130. The current control section 182 adjusts a modulation signal transmitted to the drive circuit 160 so that the driving current becomes the upper limit value or less.

The control device 180 controls the inverter 130 while communicating with a host control device 20. When the electric compressor 10 is used as a part of a refrigeration system mounted on a vehicle, an ECU for vehicle control or an ECU for air conditioning control corresponds to the host control device 20. The control device 180 controls the entire operation of the electric compressor 10 in accordance with an operation request transmitted from the host control device 20.

Figure 2:
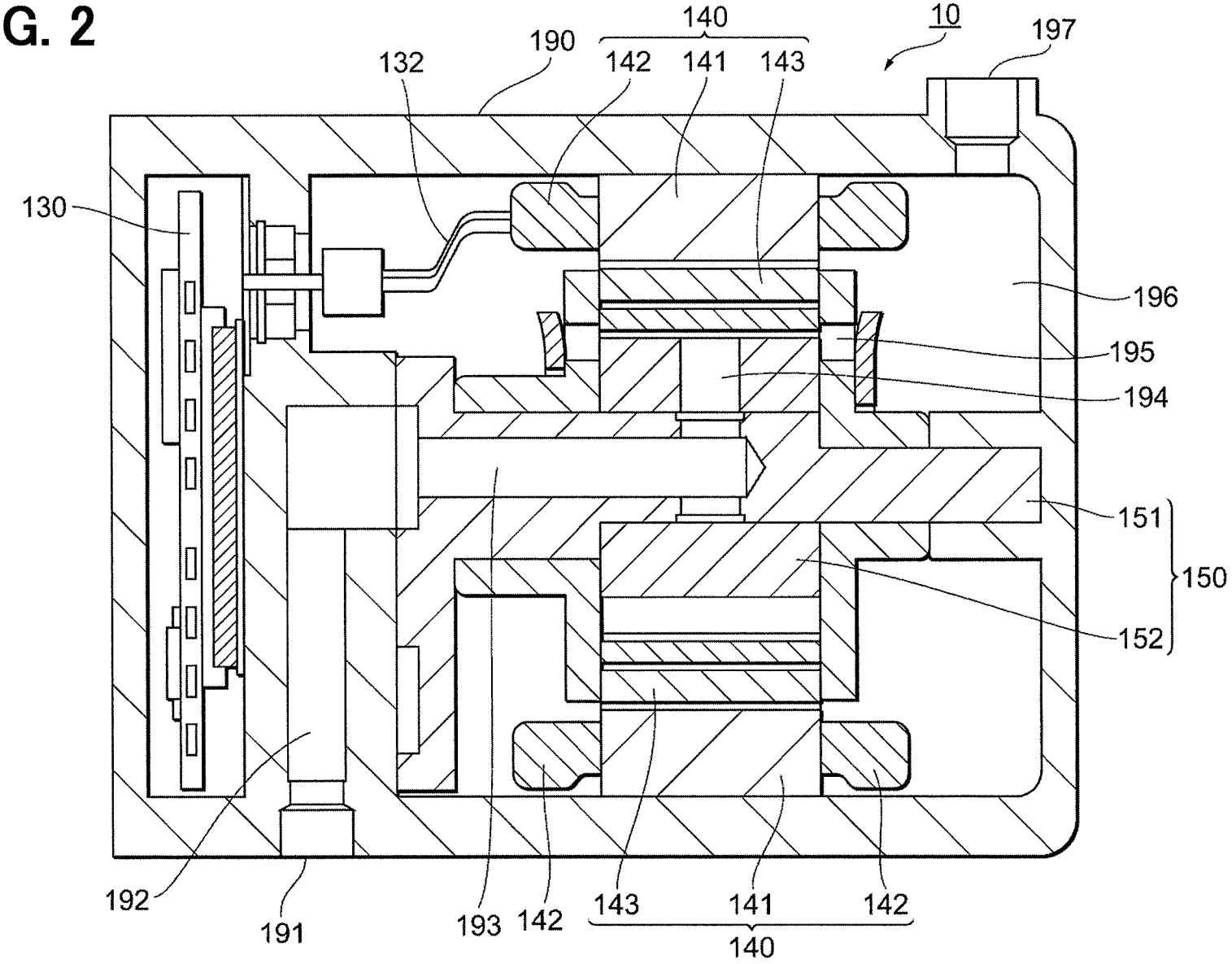
FIG. 2 is a sectional view of the internal configuration of the electric compressor.

The specific configuration of the electric compressor 10 will be described with reference to FIG. 2. FIG. 2 illustrates the configuration of the inside of a casing 190 in the electric compressor 10. In the configuration illustrated in FIG. 1, the high-voltage battery 110, the relay system 120, the drive circuit 160, the detection circuit 170, and the control device 180 are disposed outside the casing 190. Thus, these members are not illustrated in FIG. 2.

The casing 190 is a container that is formed in a substantially columnar shape as a whole. Passages (192, 193, 194, 195, 196) through which a refrigerant passes are formed inside the casing 190. The most upstream end of the passages is open on the side face of the casing 190. The opening serves as an inlet port 191 of the refrigerant. The most downstream end of the passages is also open on the side face of the casing 190. The opening serves as an outlet port 197 of the refrigerant.

A shaft 151 which is a part of the compression mechanism 150 is fixed inside the casing 190. The shaft 151 has an elongated columnar shape. The central axis of the shaft 151 is parallel to the central axis of the casing 190. The passage 193 is formed inside the shaft 151 along the central axis.

A rotor 152 which is a part of the compression mechanism 150 is disposed outside the shaft 151. The rotor 152 includes two tubular bodies. The tubular bodies are eccentric to each other and rotatably disposed around the shaft 151. When a driving current is supplied to the motor 140, and a rotor 143 of the motor 140 rotates, the rotor 152 also rotates with the rotation of the rotor 143. At this time, the shape of a gap inside the rotor 152 (a gap formed between the two tubular bodies) changes. Accordingly, the refrigerant is compressed in the gap. The compressed refrigerant passes through the passage 195 and the passage 196 in this order. Then the compressed refrigerant is fed to the outside through the outlet port 197.

The passage 194 is formed on one of the two tubular bodies, which constitute the rotor 152, disposed on the inner side. The passage 194 allows the passage 193 formed inside the shaft 151 and the gap inside the rotor 152 to communicate with each other. When the rotor 152 rotates, the refrigerant passes through the passage 193 and the passage 194 in this order and arrives at the gap in the rotor 152. Accordingly, the refrigerant is compressed in the gap as described above.

The motor 140 is disposed outside the rotor 152. The motor 140 includes a stator 141 and the rotor 143.

The rotor 143 is formed in a cylindrical shape and stores the rotor 152 inside thereof. The inner peripheral face of the rotor 143 is fixed to the rotor 152. Thus, when the rotor 143 rotates, the rotor 152 also rotates together with the rotor 143. The rotor 143 is provided with a plurality of permanent magnets.

The stator 141 is formed in a cylindrical shape and stores the rotor 143 inside thereof. The stator 141 is fixed to the inner peripheral face of the casing 190. A coil 142 is held by the stator 141. The coil 142 is part where the driving current supplied from the inverter 130 flows. The driving current is supplied from the inverter 130 to the coil 142 through a conducting wire 132.

When the driving current flows through the coil 142, the rotor 143 and the rotor 152 rotate together by an electromagnetic force. Accordingly, the compression mechanism 150 is driven, and the compression and feeding of the refrigerant are performed.

In the configuration of the electric compressor 10, the configurations of the motor 140 and the compression mechanism 150 described above are similar to the configurations described in JP-2014-5795-A. Thus, description of a more detailed configuration and a specific operation of the compression mechanism 150 will be omitted.

The passage 192 allows the flow passage 193 formed inside the shaft 151 and the inlet port 191 to communicate with each other. The refrigerant passes through the passage 192 before compressed by the compression mechanism 150. Thus, the refrigerant passing through the passage 192 has a low temperature and a low pressure.

The inverter 130 is disposed inside the casing 190 at a position opposite to the motor 140 across the passage 192.

That is, the inverter 130 is disposed at the position on the upstream side relative to the compression mechanism 150 along the flow of the refrigerant.

As illustrated in FIG. 2, the passage 192 is formed near the inverter 130 along the inverter 130. Thus, when a refrigerant having a low temperature flows through the passage 192, the inverter 130 is cooled by the refrigerant.

The motor 140 surrounds the periphery of the compression mechanism 150. The distance between the motor 140 and the compression mechanism 150 is relatively small. Thus, when the electric compressor 10 operates, and the refrigerant is compressed by the compression mechanism 150, the motor 140 is heated by the compressed refrigerant having a high temperature.

Figure 3:
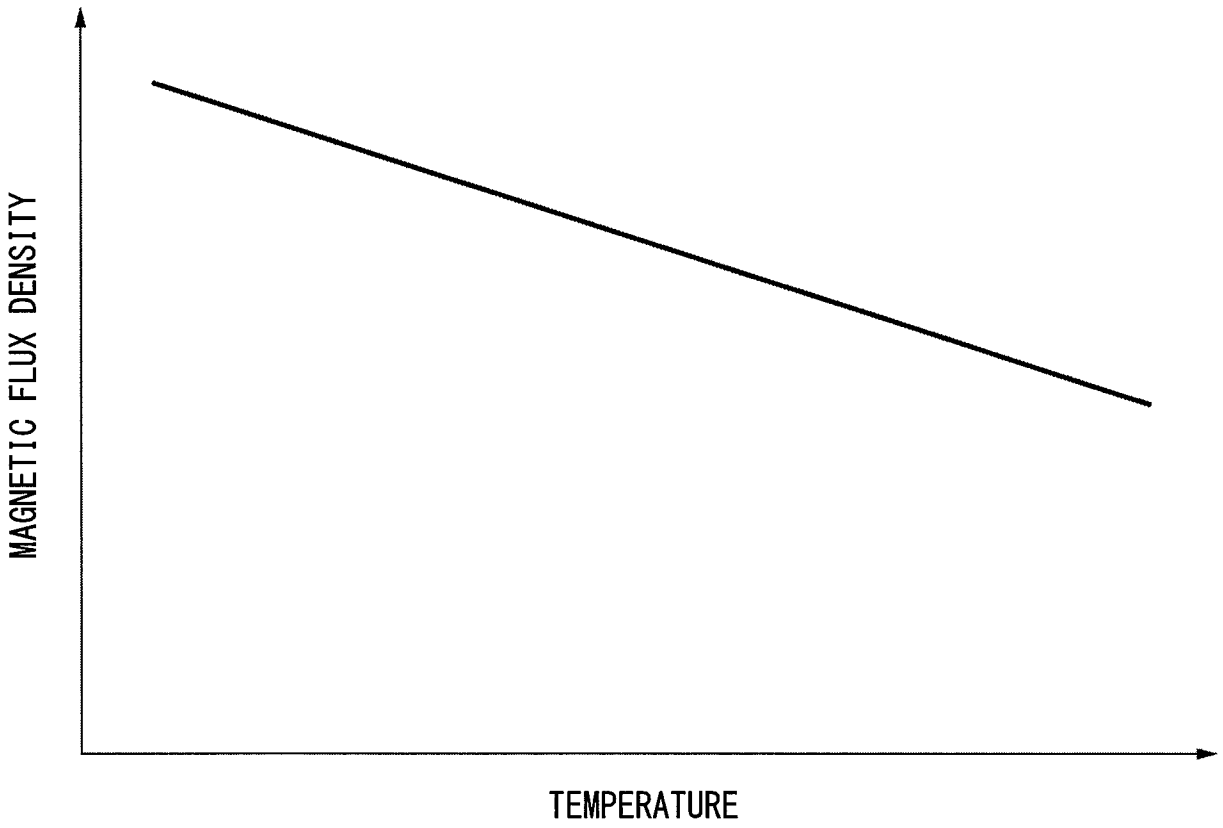
FIG. 3 is a graph illustrating the relationship between a temperature and a magnetic flux density in a motor.

A phenomenon that occurs when the motor 140 is heated and has a high temperature will be described. It is known that, in a motor that is driven by an electromagnetic force like the motor 140 of the present embodiment, a magnetic flux density decreases as the temperature increases as illustrated in FIG. 3. Thus, when the motor 140 is heated as described above, the torque of the motor 140 and the compression mechanism 150 also disadvantageously decreases with the decrease in the magnetic flux density.

Figure 4:
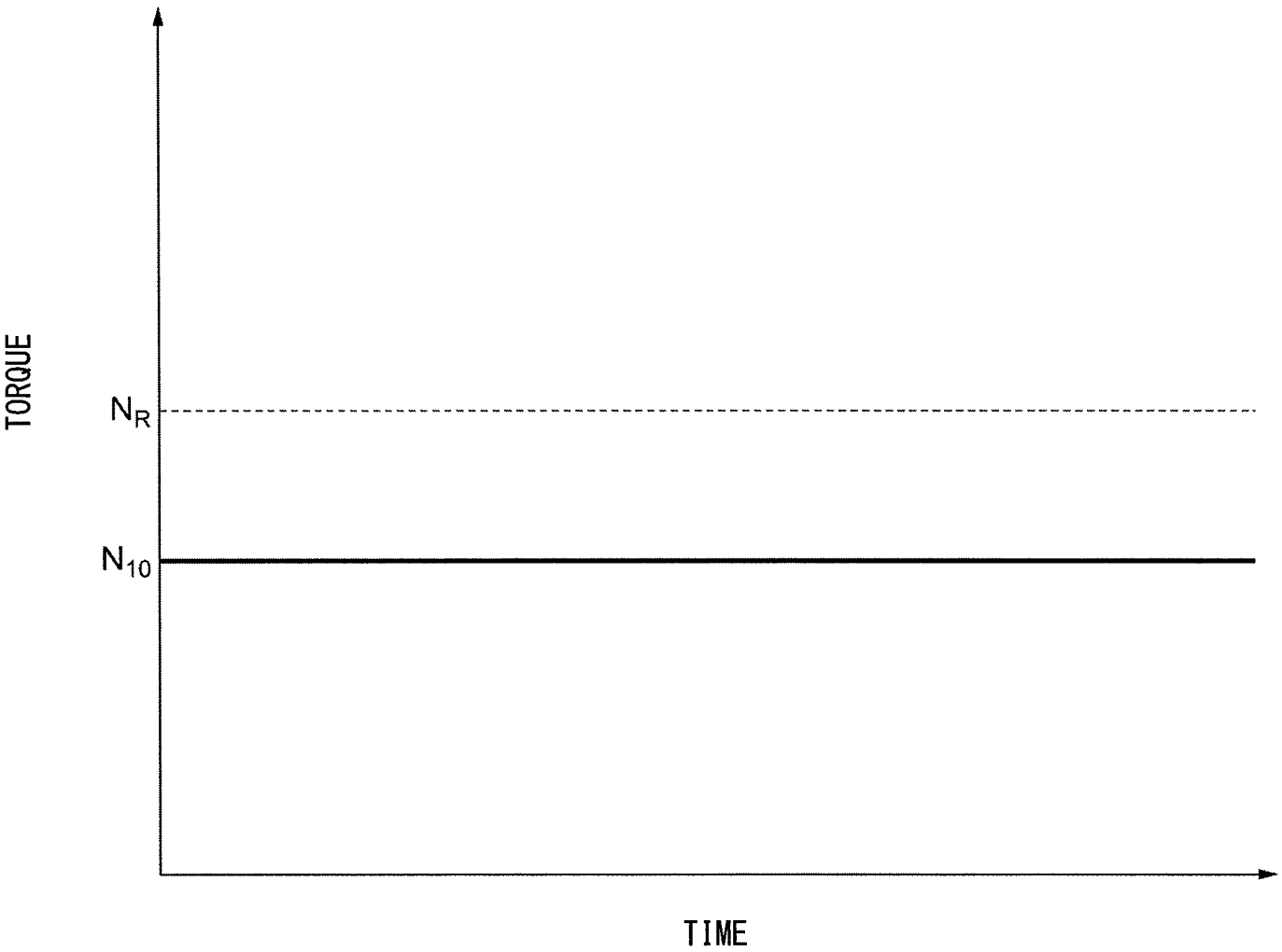
FIG. 4 is a graph illustrating a change in torque when the temperature of the motor is high.

As a result, as illustrated in FIG. 4, a torque $N_{10}$ of the compression mechanism 150 may fall below a required torque $N_R$ which is required for the electric compressor 10 to exhibit the performance. In particular, during a startup of the electric compressor 10, a rotation angle, that is, the phase of the rotor 143 in the motor 140 is unstable. Thus, the required torque $N_R$ during the startup of the electric compressor 10 is higher than that during a steady operation. Thus, when the electric compressor 10 is temporarily stopped and then restarted within a relatively short time, a torque equal to or higher than the required torque $N_R$ cannot be output due to a high temperature of the motor 140. Therefore, the restart of the electric compressor 10 may be impossible.

Thus, in the control device 180 of the electric compressor 10 according to the present embodiment, when the torque may decrease with a temperature rise in the motor 140, an upper limit value calculated by the upper limit value calculation section 181 is made higher than an upper limit value under normal conditions. Accordingly, it is possible to temporarily increase the driving current supplied to the motor 140 to make the torque of the compression mechanism 150 equal to or higher than the required torque $N_R$.

Figure 5:
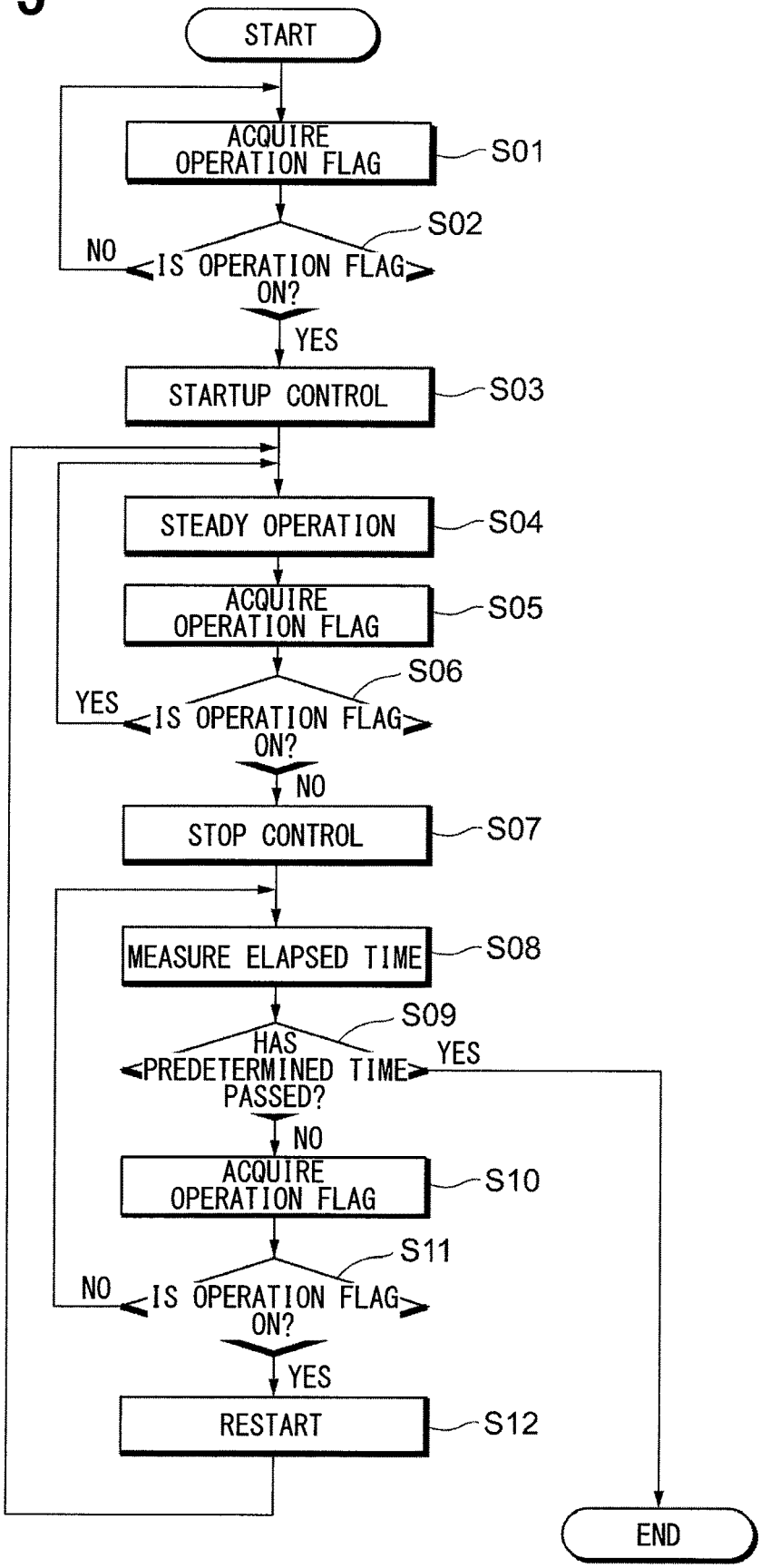
FIG. 5 is a flowchart illustrating the flow of a process executed by a control device of the electric compressor.

The details of a process performed by the control device 180 will be described with reference to FIG. 5. Hereinbelow, an example in which the process of FIG. 5 is started in a state in which the electric compressor 10 is stopped for a long time, and the motor 140 and the compression mechanism 150 have a normal temperature will be described.

In the first step S01, an operation flag is acquired. The operation flag is a signal that is periodically transmitted from the host control device 20 to the control device 180 and indicates whether to actuate (to turn ON) or to stop (to turn OFF) the electric compressor 10. The operation flag may not be a signal indicating ON or OFF as described above, but may be a signal indicating a specific physical quantity such as rotation speed indication.

In step S02 following step S01, it is determined whether the acquired operation flag is ON, that is, whether the host control device 20 provides an instruction to operate the electric compressor 10. When the operation flag is OFF, the processes of step S01 and the subsequent step are repeatedly executed. When the operation flag is ON, the process shifts to step S03.

In step S03, startup control is performed. In the startup control, a driving current from the inverter 130 is supplied to the motor 140. Accordingly, the rotor 152 of the compression mechanism 150 starts rotating.

At this time, the temperature of the motor 140 is sufficiently low, and the magnetic flux density illustrated in FIG. 3 is relatively high. Thus, the torque of the compression mechanism 150 exceeds the required torque $N_R$, and the compression and feeding of the refrigerant by the electric compressor 10 are stably performed.

When the rotation speed of the rotor 152 increases and becomes stable after the startup control of step S03, the process shifts to step S04, and a steady operation is performed. In step S05 following step S04, an operation flag is acquired again. At this time, the steady operation of the electric compressor 10 is continuously performed.

In step S06 following step S05, similarly to step S02, it is determined whether the acquired operation flag is ON. When the operation flag is ON, the processes of step S04 and the subsequent steps are repeatedly executed, and the steady operation of the electric compressor 10 is continued. When the operation flag is OFF, the process shifts to step S07.

In step S07, stop control is performed. The stop control is performed for stopping the operation of the electric compressor 10. When the operation of the electric compressor 10 comes to a stop by completion of the stop control, the process shifts to step S08.

In step S08, an elapsed time from the completion of the stop control is measured. In step S09 following step S08, it is determined whether the measured elapsed time exceeds a predetermined time. The predetermined time is previously set as a time that is required for the temperature of the motor 140 to drop to a temperature near the normal temperature after the stop of the electric compressor 10. In other words, the predetermined time is previously set as a time that is required for the temperature of the motor 140 to drop to a degree with which a decrease in the magnetic flux density in the motor 140 is negligible.

When the elapsed time exceeds the predetermined time, a series of processes illustrated in FIG. 5 is finished. Then, when the operation flag from the host control device 20 is turned ON again, the processes of step S03 and the subsequent steps are executed again.

In step S09, when the elapsed time is less than the predetermined time, the process shifts to step S10. In step S10, an operation flag is acquired again.

In step S11 following step S10, similarly to step S02 and step S06, it is determined whether the acquired operation flag is ON. When the operation flag is OFF, the processes of step S08 and the subsequent steps are repeatedly executed. When the operation flag is ON, the process shifts to step S12. In step S12, a process for restarting the stopped electric compressor 10 is performed. Upon completion of the restart, the processes of step S04 and the subsequent steps are executed again.

A process performed in step S12 is a process for restarting the electric compressor 10 within a relatively short time after the stop of the electric compressor 10 (that is, before the elapse of the predetermined time).

Hereinbelow, this process is also referred to as a "high-temperature time restarting process". The present embodiment differs from a conventional technique in a mode of the high-temperature time restarting process.

The details of the process during a restart (that is, the high-temperature time restarting process) performed in step S12 will be described with reference to FIG. 6. In the first step S121, the temperature of the motor 140 is acquired through the detection circuit 170. In step S122 following step S121, the temperature of the inverter 130 is acquired through the detection circuit 170.

In step S123 following step S122, an upper limit value of the driving current is calculated and set by the upper limit value calculation section 181 on the basis of the temperature of the motor 140 and the temperature of the inverter 130. In step S124 following step S123, startup control similar to step S03 of FIG. 5 is performed. During the startup control, the driving current is regulated to be within a range of the set upper limit value or less.

Figure 7:
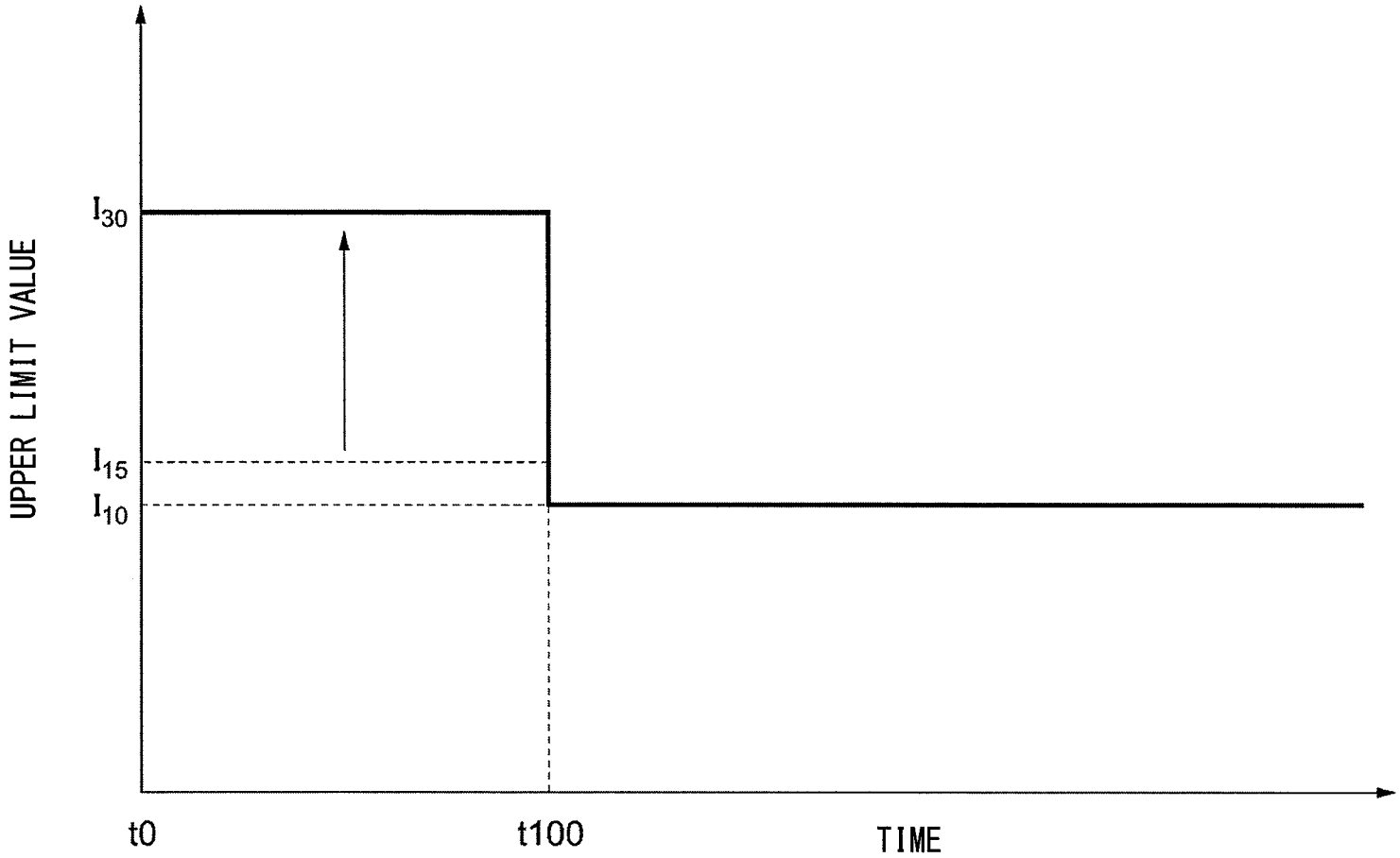
FIG. 7 is a graph illustrating a change in an upper limit value set for a driving current.

FIG. 7 illustrates an example of a change in the upper limit value. In the example of FIG. 7, the restart of the electric compressor 10 is completed at time t100, and a steady operation is performed thereafter. In a period before time t100, that is, a period during which the restart is performed, the upper limit value of the driving current is set to a value $I_{30}$ which is higher than an upper limit value (value $I_{10}$) in a period during which the steady operation is performed.

In FIG. 7, a reference sign "$I_{15}$" represents an upper limit value that is set when a startup of the electric compressor 10, that is, the startup control in step S03 of FIG. 5 is performed with the motor 140 having a normal temperature. Hereinbelow, a time when the normal startup as described above is performed is also referred to as a "normal startup time".

The normal startup time can also be defined as a time when the operation of the motor 140 is started in a state in which the pressure of the refrigerant inside the casing 190 is uniform between the upstream side and the downstream side of the compression mechanism 150, and the temperature of the motor 140 is equal to the temperature of the inverter 130. The value $I_{15}$, which is the upper limit value set in the normal startup time, is set to a value that is slightly higher than the upper limit value (value $I_{10}$) in a period during which the steady operation is performed.

As illustrated in FIG. 7, the upper limit value (value $I_{30}$) set in step S123 is higher than the upper limit value (value $I_{15}$) set in the normal startup time. In this manner, in the present embodiment, the upper limit value of the driving current supplied to the motor 140 is changed from the value $I_{15}$ to the value $I_{30}$ on the basis of the temperature of the motor 140 and the temperature of the inverter 130. Accordingly, a value of the driving current during the restart is increased.

Figure 8:
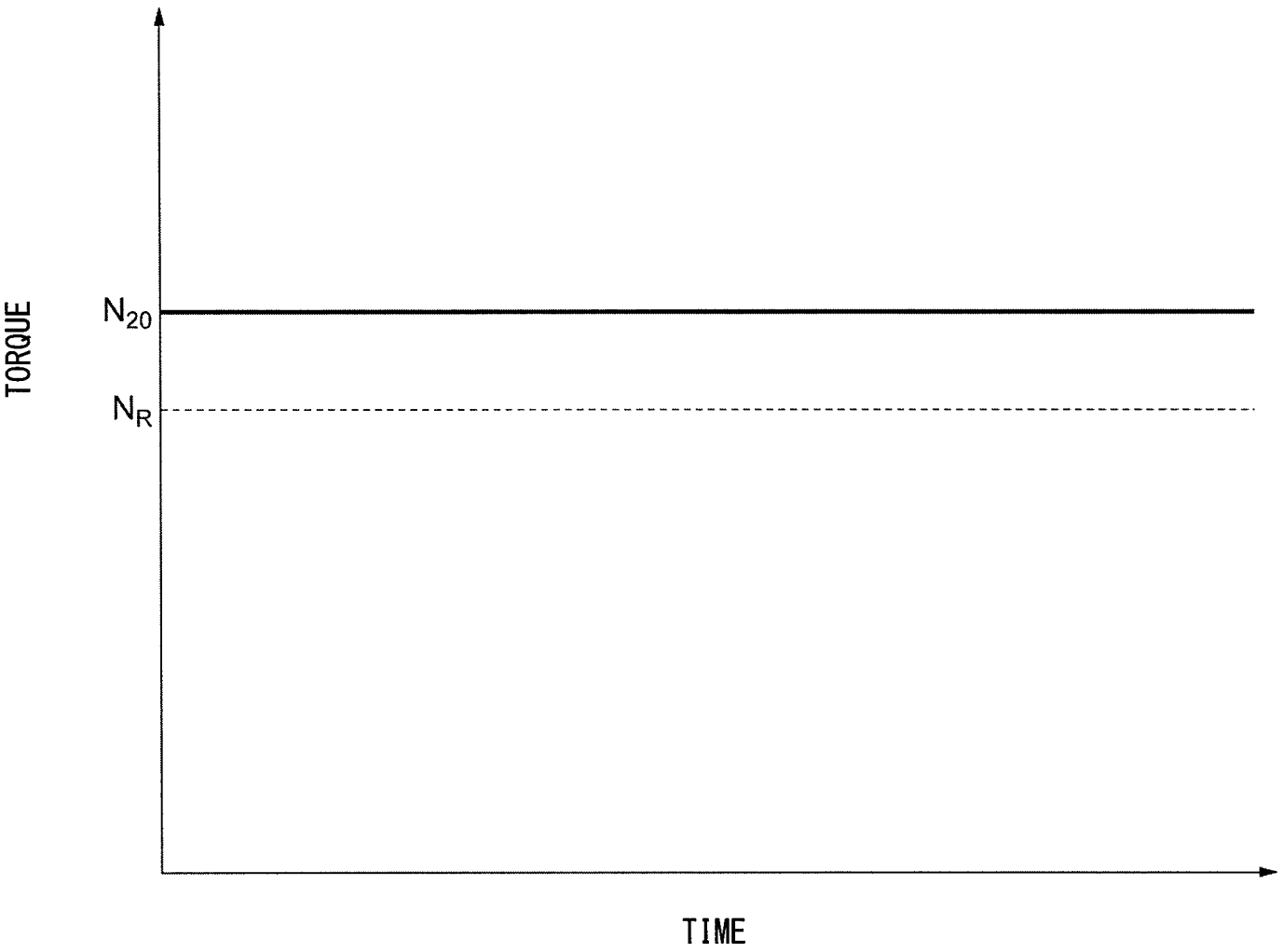
FIG. 8 is a graph illustrating a change in torque when the temperature of the motor is high.

As a result, as illustrated in FIG. 8, a torque $N_{20}$ of the compression mechanism 150 becomes higher than the torque $N_{10}$ illustrated in FIG. 4 and higher than the required torque $N_R$. Thus, although the magnetic flux density decreases in the motor 140 due to a temperature rise, the compression and feeding of the refrigerant by the electric compressor 10 are stably performed.

When the upper limit value of the driving current increases as described above, a heat generation amount of the inverter 130 also increases with the increase of the upper limit value. Thus, the temperature of the inverter 130 increases, which may make the operation unstable. However, in the electric compressor 10 having the configuration illustrated in FIG. 2, the inverter 130 is disposed at a position on the upstream side relative to the compression mechanism 150 and the position cooled by the refrigerant. Thus, even when the heat generation amount of the inverter 130 increases due to the change in the upper limit value, an excessive temperature rise in the inverter 130 is prevented.

The upper limit value to be set may be increased as the temperature of the motor 140 increases. Further, the upper limit value to be set may be increased as the temperature of the inverter 130 decreases. The relationship between the temperature of the motor 140 and the temperature of the inverter 130 and the upper limit value which is set on the basis of these temperatures is desirably created as a map in advance on the basis of an experiment and stored in the ROM included in the control device 180.

In the present embodiment, the upper limit value of the driving current is set on the basis of both of the temperature of the motor 140 and the temperature of the inverter 130. However, the upper limit value may be set on the basis of only either the temperature of the motor 140 or the temperature of the inverter 130.

The upper limit value may be set on the basis of not a measured value of the temperature of the motor 140, but information that indirectly indicates the temperature of the motor 140. The "information that indirectly indicates the temperature of the motor 140" is, for example, an elapsed time from the stop of the motor 140. In this manner, the upper limit value may be set on the basis of the temperature of the motor 140 or the information indirectly indicating the temperature (the temperature and the information correspond to "information relating to the temperature" of the motor 140).

Similarly, the upper limit value may be set on the basis of not a measured value of the temperature of the inverter 130, but information that indirectly indicates the temperature of the inverter 130. The "information that indirectly indicates the temperature of the inverter 130" is, for example, a switching period of the switching elements 131. In this manner, the upper limit value may be set on the basis of the temperature of the inverter 130 or the information indirectly indicating the temperature (the temperature and the information correspond to "information relating to the temperature" of the inverter 130).

Figure 9:
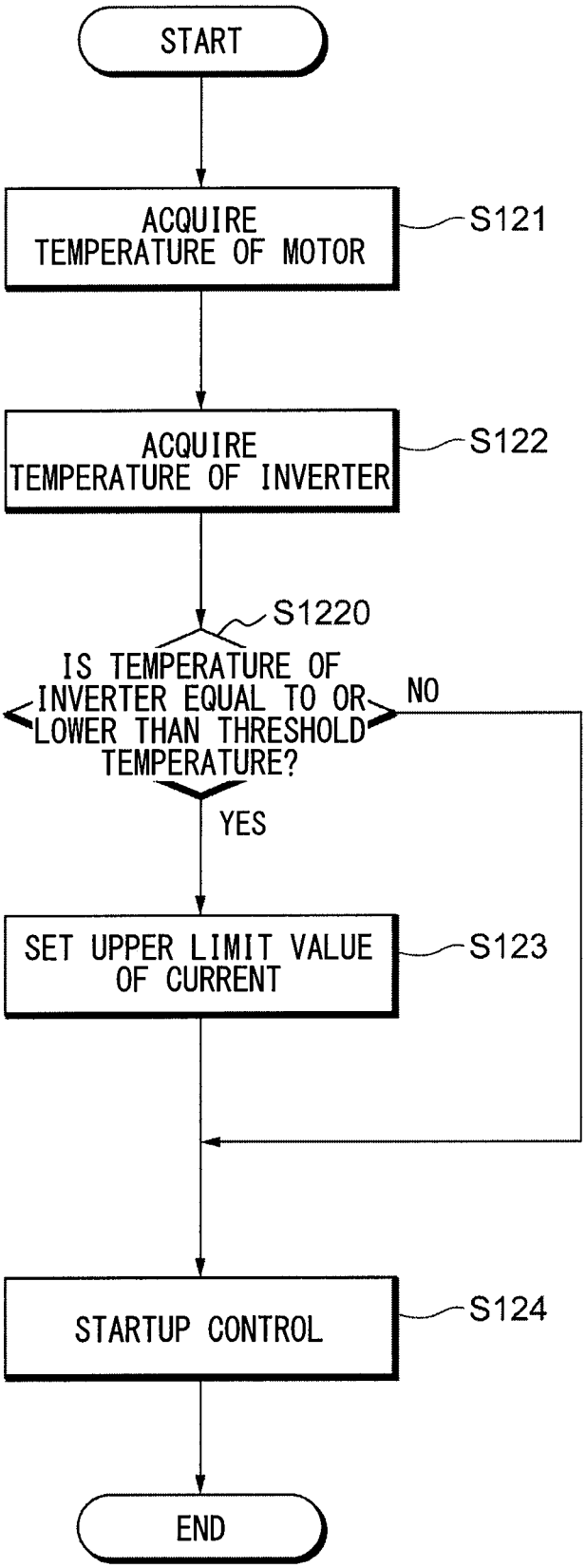
FIG. 9 is a flowchart illustrating the flow of a process executed by a control device of an electric compressor according to a second embodiment.

A second embodiment will be described. The second embodiment differs from the first embodiment in the details of the high-temperature time restarting process and similar to the first embodiment in the other points. A high-temperature time restarting process in the second embodiment will be described with reference to FIG. 9. A series of processes illustrated in FIG. 9 is executed instead of the series of processes illustrated in FIG. 6.

Figure 6:
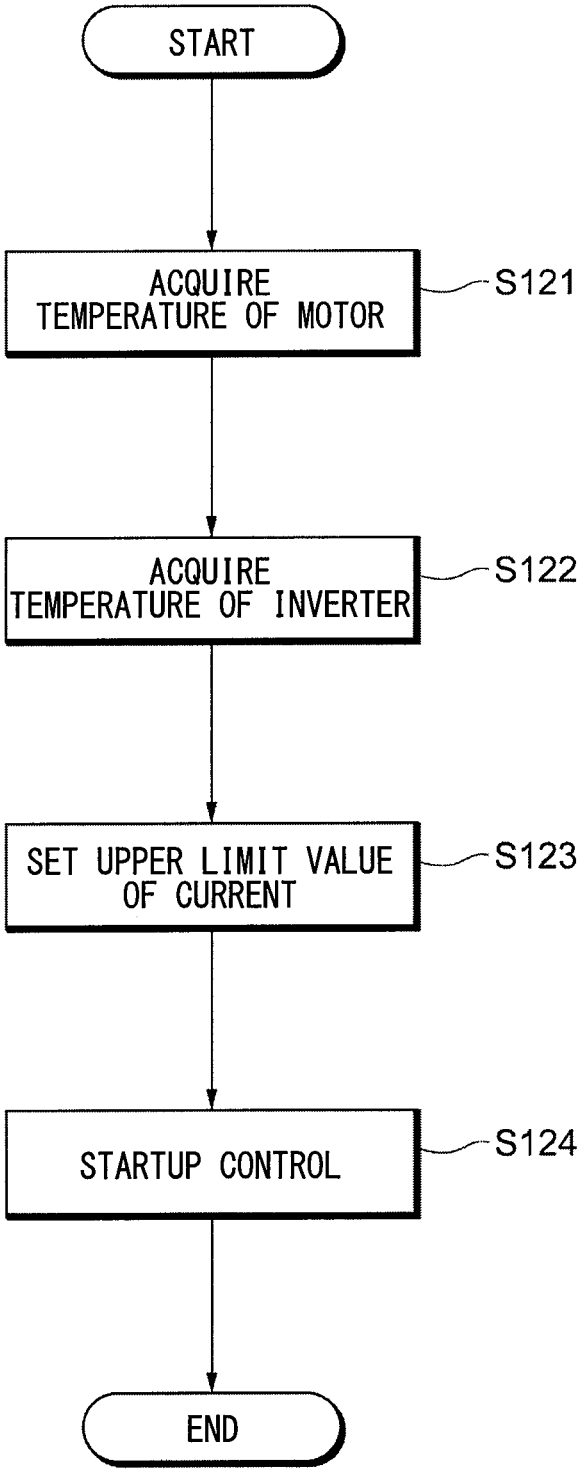
FIG. 6 is a flowchart illustrating the flow of a process executed by a control device of the electric compressor.

A process performed in the first step S121 and a process performed in step S122 following step 121 are the same as the process performed in step S121 and the process performed in step S122 illustrated in FIG. 6, respectively.

In step S1220 following step S122, it is determined whether the temperature of the inverter 130 is equal to or lower than a predetermined threshold temperature. The temperature of the inverter 130 is acquired through the detection circuit 170. The threshold temperature is previously set as a value within a temperature range in which the switching operation in the inverter 130 is appropriately performed.

When the temperature of the inverter 130 is equal to or lower than the threshold temperature, the process shifts to step S123. A process performed in step S123 and a process performed in step S124 following step S123 are the same as the process performed in step S123 and the process performed in step S124 illustrated in FIG. 6, respectively. That is, the upper limit value is changed to a value that is higher than the upper limit value (value $I_{15}$) in the normal startup time, so that the torque of the compression mechanism 150 is raised to the required torque $N_R$ or more.

When the temperature of the inverter 130 is higher than the threshold temperature in step S1220, the process shifts to step S124 without going through step S123. That is, the upper limit value is not changed, and the startup control of step S124 is performed with the upper limit value (value $I_{15}$) of the normal startup time.

Figure 10:
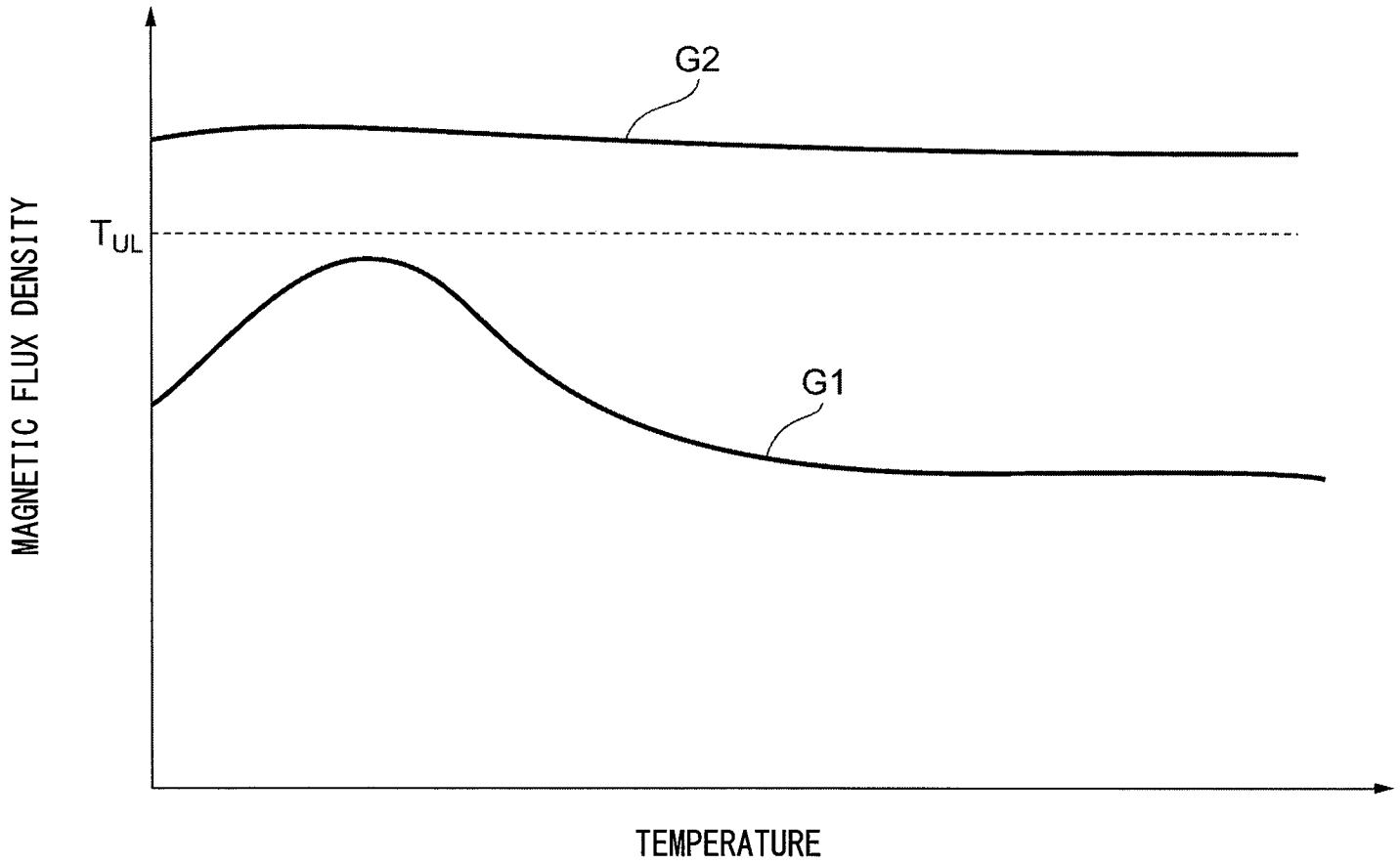
FIG. 10 is a graph illustrating changes in the temperature of an inverter and changes in the temperature of a motor.

In this manner, in the present embodiment, the control device 180 is configured to change the upper limit value only when the temperature of the inverter 130 is equal to or lower than the predetermined threshold temperature. Thus, as illustrated in FIG. 10, even when the temperature (G2) of the motor 140 is high, the temperature (line G1) of the inverter 130 never exceeds a temperature upper limit $T_{UL}$. Thus, an unstable operation caused by an excessive temperature rise in the inverter 130 is reliably prevented. The temperature upper limit $T_{UL}$ is a temperature corresponding to an upper limit of a temperature range in which the switching operation in the inverter 130 is appropriately performed. The threshold temperature is set as a temperature lower than the temperature upper limit $T_{UL}$.

Figure 11:
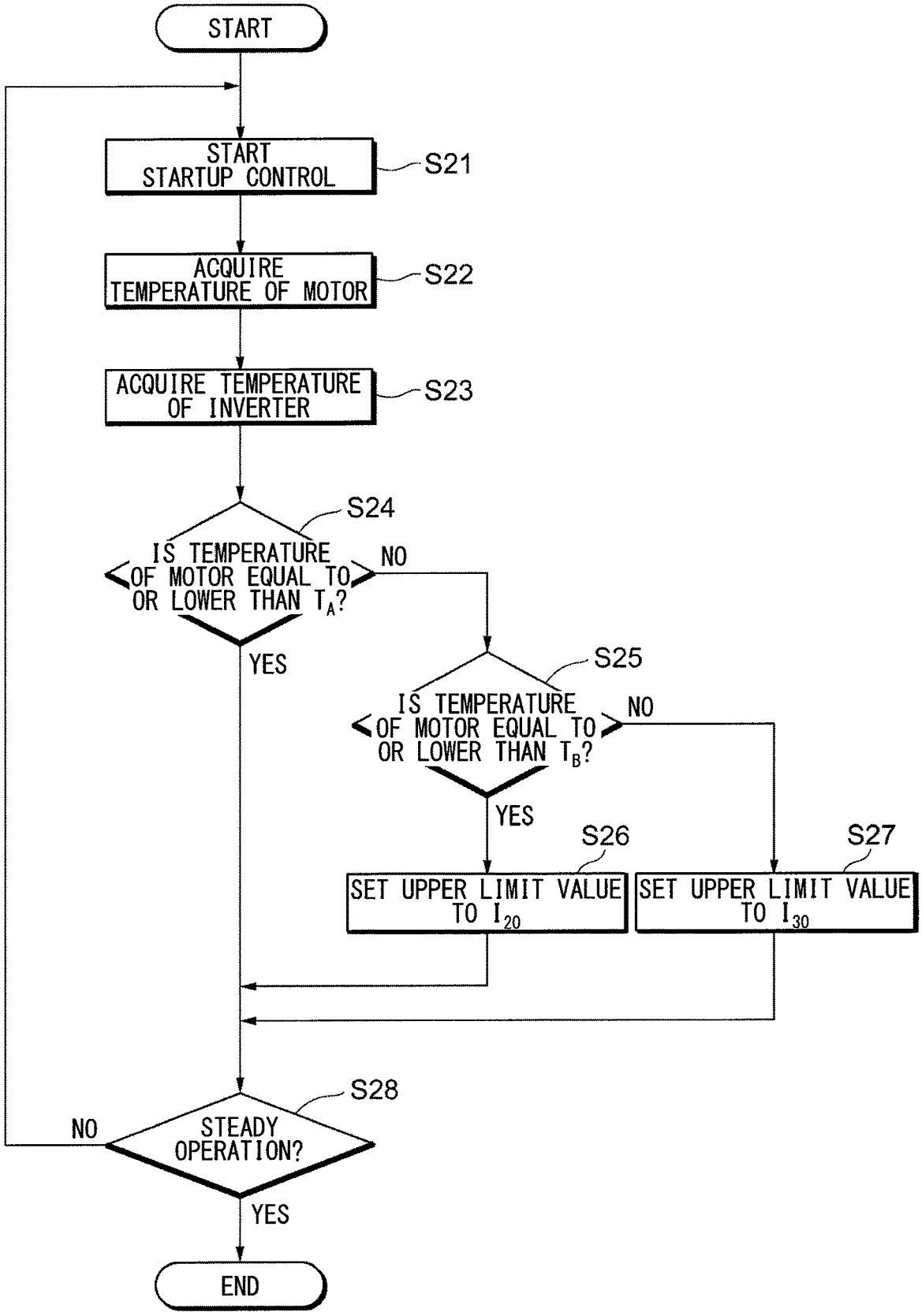
FIG. 11 is a flowchart illustrating the flow of a process executed by a control device of an electric compressor according to a third embodiment.

A third embodiment will be described. The third embodiment differs from the first embodiment in the details of the high-temperature time restarting process and similar to the first embodiment in the other points. A high-temperature time restarting process in the third embodiment will be described with reference to FIG. 11. A series of processes illustrated in FIG. 11 is executed instead of the process of step S124 illustrated in FIG. 6.

In the first step S21, startup control similar to step S03 of FIG. 3 is started. With the start of the startup control, a driving current from the inverter 130 is supplied to the motor 140. Accordingly, the rotor 152 of the compression mechanism 150 starts rotating. Then, the process immediately shifts to step S22 without waiting for the end of the startup control.

In step S22, the temperature of the motor 140 is acquired again through the detection circuit 170. In step S23 following step S22, the temperature of the inverter 130 is acquired again through the detection circuit 170.

In step S24 following step S23, it is determined whether the temperature of the motor 140 is equal or lower than a predetermined set temperature $T_A$. The set temperature $T_A$ is previously set as a sufficiently low temperature with which the magnetic flux density in the motor 140 is almost negligible. When the temperature of the motor 140 is equal to or lower than the set temperature $T_A$, the process shifts to step S28 (described below). At this time, the upper limit value of the driving current is the value $I_{15}$ (that is, the upper limit value set in the normal startup time).

When the temperature of the motor 140 is higher than the set temperature $T_A$ in step S24, the process shifts to step S25. In step S25, it is determined whether the temperature of the motor 140 is equal or lower than a predetermined set temperature $T_B$. The set temperature $T_B$ is previously set as a temperature that is higher than the set temperature $T_A$.

When the temperature of the motor 140 is equal or lower than the set temperature $T_B$, the process proceeds to step S26. In step S26, the upper limit value of the driving current is set to a value $I_{20}$. The value $I_{20}$ is previously set as a value that is lower than the value $I_{30}$ illustrated in FIG. 7 and higher than the value $I_{15}$. Thereafter, the driving current supplied from the inverter 130 to the motor 140 is regulated within the range of the value $I_{20}$ or less. After the process of step S26, the process shifts to step S28.

When the temperature of the motor 140 is higher than the set temperature $T_B$ in step S25, the process shifts to step S27. In step S27, the upper limit value of the driving current is set to the value $I_{30}$. As already described above, the value $I_{30}$ is previously set as a value that is higher than all the values $I_{10}$, $I_{15}$, and $I_{20}$. Thereafter, the driving current supplied from the inverter 130 to the motor 140 is regulated within the range of the value $I_{30}$ or less. After the process of step S27, the process shifts to step S28.

In step S28, it is determined whether the startup control has been completed and a shift to a steady operation has been made. When the shift to the steady operation has not yet been made, the processes of step S21 and the subsequent steps are executed again. When the shift to the steady operation has been made, the series of processes illustrated in FIG. 11 is finished. Thereafter, the processes of step S05 and the subsequent steps illustrated in FIG. 5 are executed.

As described above, in the present embodiment, the upper limit value of the driving current is changed in stages on the basis of information relating to the temperature of the motor 140. For example, when the temperature of the motor 140 gradually decreases during the execution of the high-temperature time restarting process, the upper limit value is changed in stages to the value $I_{30}$, the value $I_{20}$, and the value $I_{15}$ in this order with the decrease in the temperature of the motor 140. An appropriate upper limit value corresponding to the condition at each point in time is set by changing the upper limit value in stages.

In the present embodiment, the upper limit value is changed in three stages. However, the number of stages may be four or more or two or less. In the present embodiment, the upper limit value is changed in stages on the basis of the temperature of the motor 140. However, the upper limit value may be changed in stages on the basis of information relating to the temperature of the inverter 130. Further, the upper limit value may be changed in stages on the basis of both of information relating to the temperature of the motor 140 and information relating to the temperature of the inverter 130.

Figure 12:
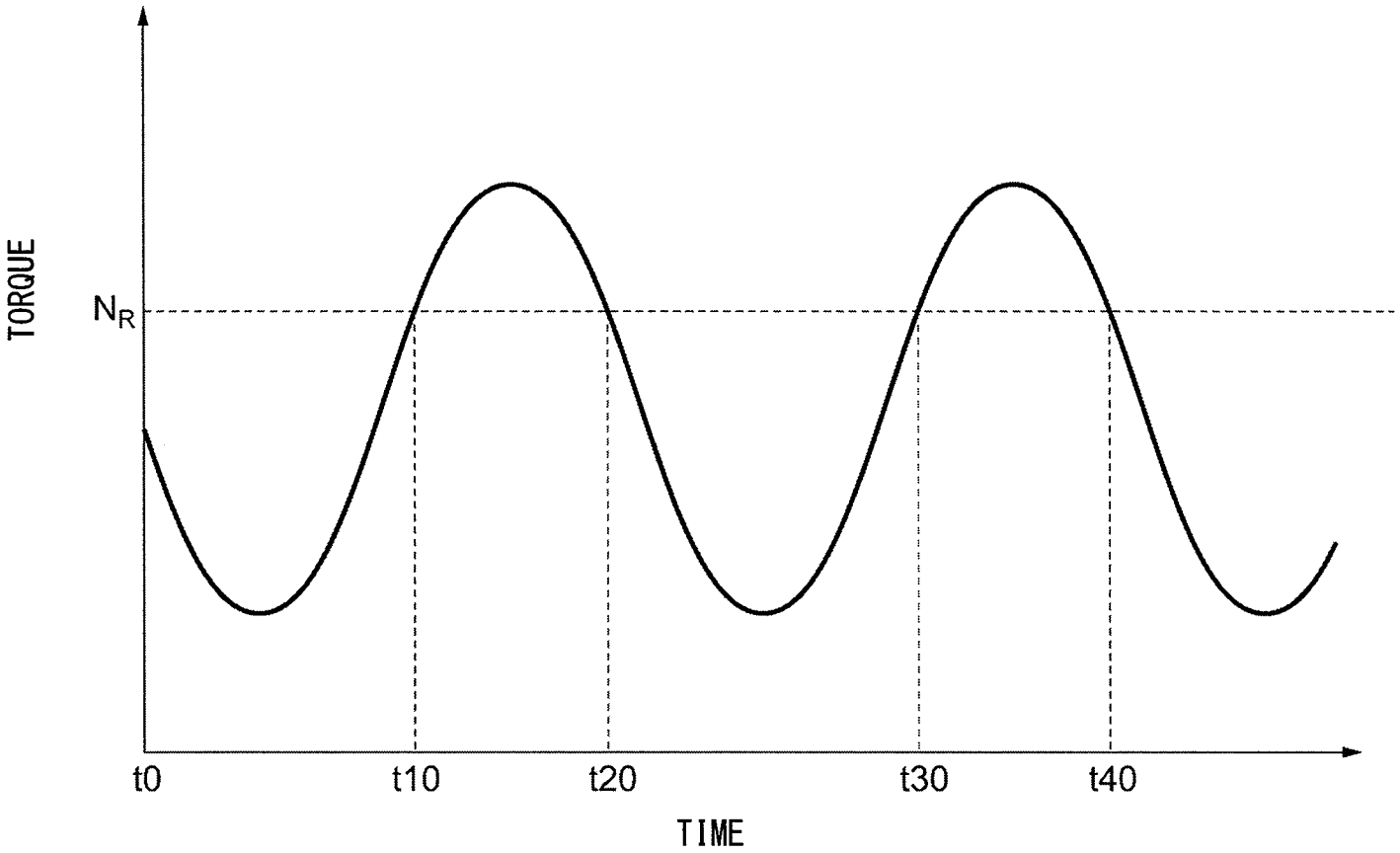
FIG. 12 is a graph illustrating changes in the torque of a compression mechanism.

The compression mechanism 150 is configured to repeatedly perform the compression and feeding of the refrigerant by rotating the rotor 152. Thus, the torque of the compression mechanism 150 is not always constant, but periodically varies in synchronization with changes in the rotation angle of the rotor 152. FIG. 12 illustrates an example of the changes in the torque varying as described above.

Figure 13:
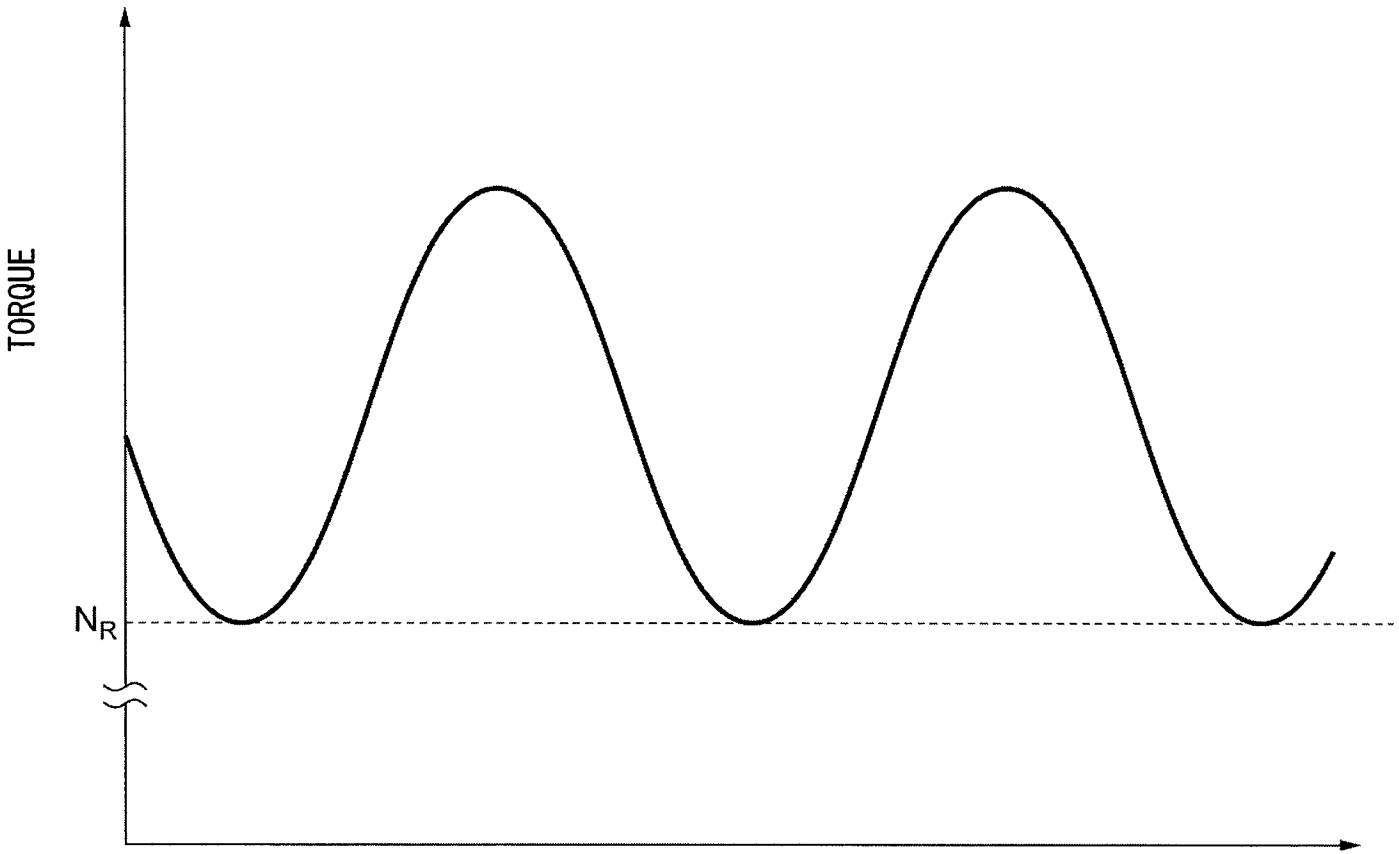
FIG. 13 is a graph illustrating changes in the torque of the compression mechanism.

In the example of FIG. 12, the torque of the compression mechanism 150 temporarily falls below the required torque $N_R$ due to the variations in the torque. In the case of such an example, the upper limit value of the driving current is desirably changed so that a minimum value in the variations in the torque becomes equal to or higher than the required torque $N_R$. In this manner, the upper limit value calculation section 181 may calculate and set the upper limit value so that the actual torque is always equal to or higher than the required torque $N_R$ taking the variations in the torque into consideration in advance. FIG. 13 illustrates changes in the torque of the compression mechanism 150 in a case where the upper limit value is set as described above.

Figure 14:
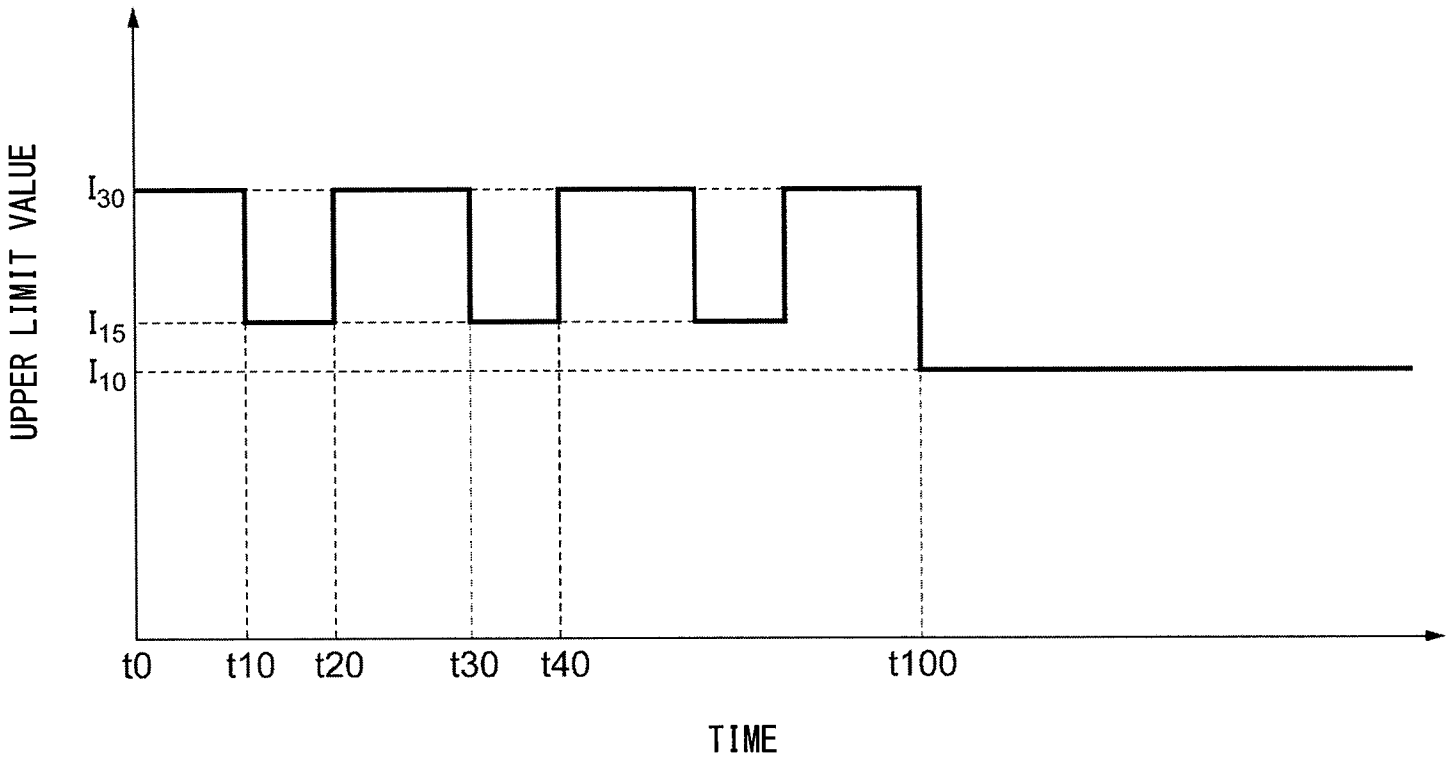
FIG. 14 is a graph illustrating changes in an upper limit value set for a driving current.

In the example of FIG. 12, the torque of the compression mechanism 150 is lower than the required torque $N_R$ in a period from time t0 to t10, a period from t20 to t30, and a period after time t40. The upper limit value of the driving current may be changed to a value higher than the upper limit value (value $I_{15}$) in the normal startup time only in the periods as described above. FIG. 14 illustrates an example of changes in the upper limit value changed in this manner. The upper limit value is repeatedly changed between the value $I_{15}$ and the value $I_{30}$ until time t100 when the restart is completed. Accordingly, it is possible to always maintain the torque of the compression mechanism 150 equal to or higher than the required torque $N_R$. The control device 180 in the example of FIG. 14 changes the upper limit value in synchronization with variations in the torque so that the torque of the compression mechanism 150 is always equal to or higher than the required torque $N_R$.

A mode in which the upper limit value is changed from the value 115 only when the restart of the electric compressor 10 is performed has been described above. However, the present disclosure is not necessarily limited to the mode described above. The upper limit value may be changed according to, for example, the temperature of the motor 140 also in a period during which the steady operation is performed after the completion of the restart.

The embodiments have been described above with reference to the concrete examples. However, the present disclosure is not limited to the concrete examples described above. The concrete examples with design modifications appropriately added by those skilled in the art are also included in the scope of the present disclosure as long as they have features of the present disclosure. Each element included in each of the concrete examples, and the arrangement, condition, and shape thereof are not limited to the illustrated ones and can be appropriately modified. Further, a combination of elements included in the respective concrete examples described above can be appropriately changed unless the combination has a technical contradiction.

What is claimed is:

1. An electric compressor that compresses and feeds out a refrigerant supplied to the electric compressor, the electric compressor comprising:

a motor;

a compression mechanism that is driven by the motor to compress the refrigerant;

an inverter that supplies a driving current to the motor; and a control device that controls an operation of the inverter, wherein:

the inverter is disposed at a position which is upstream of the compression mechanism along a flow of the refrigerant and which is cooled by the refrigerant;

the motor is disposed at a position heated by the refrigerant compressed by the compression mechanism;

the control device changes an upper limit value of the driving current supplied to the motor based on at least one of a first information relating to a temperature of the motor or a second information relating to a temperature of the inverter; and the control device changes the upper limit value only when the temperature of the inverter is equal to or lower than a predetermined threshold temperature.

2. The electric compressor according to claim 1, wherein when the electric compressor is restarted, the control device changes the upper limit value to a value higher than the driving current supplied to the motor at a normal startup time.

3. The electric compressor according to claim 2, wherein the normal startup time is a time when an operation of the motor is started in a state in which a pressure of the refrigerant is uniform between the upstream side and the downstream side of the compression mechanism and the temperature of the motor is equal to the temperature of the inverter.

4. The electric compressor according to claim 1, wherein the control device changes the upper limit value in stages based on at least one of the first information or the second information.

5. The electric compressor according to claim 1, wherein:

the compression mechanism periodically varies a torque thereof when the compression mechanism compresses the refrigerant; and the control device changes the upper limit value so that a minimum value of the varying torque is equal to or higher than a predetermined required torque.

6. The electric compressor according to claim 1, wherein:

the compression mechanism periodically varies a torque thereof when the compression mechanism compresses the refrigerant; and the control device changes the upper limit value in synchronization with the variations in the torque so that the torque is always equal to or higher than a predetermined required torque.

* * * * *